US006637962B1

(12) United States Patent
Roche et al.

(10) Patent No.: US 6,637,962 B1
(45) Date of Patent: Oct. 28, 2003

(54) ERGONOMIC WRITING INSTRUMENT

(76) Inventors: Colin Roche, 1212 Galvez Dr., Pacifica, CA (US) 94044; Robert Ronsse, 3485 Alameda de las Pulgas, Apt. 4, Menlo Park, CA (US) 94025

( * ) Notice: Subject to any disclaimer, the term of this patent is extended or adjusted under 35 U.S.C. 154(b) by 0 days.

(21) Appl. No.: 10/106,667

(22) Filed: Mar. 25, 2002

(51) Int. Cl.[7] ..... A46B 5/02; B43K 5/16

(52) U.S. Cl. ..... 401/7; 401/6; 401/107; 16/430

(58) Field of Search ..... 401/7, 6, 195, 401/48, 107, 117; 16/430; D19/35, 41, 46

(56) References Cited

U.S. PATENT DOCUMENTS

| | | | | | |
|---|---|---|---|---|---|
| 336,540 | A | | 2/1886 | Wyttenbach | |
| 340,382 | A | | 4/1886 | Smith | |
| 1,879,456 | A | * | 9/1932 | Parsons | 401/7 |
| 3,741,665 | A | * | 6/1973 | Smagala-Romanoff | 401/117 |
| 4,127,338 | A | | 11/1978 | Laybourne | |
| 5,391,010 | A | | 2/1995 | Gorbunov | |
| 5,885,018 | A | | 3/1999 | Sato | |
| 6,161,974 | A | | 12/2000 | Nakagawa | |

* cited by examiner

*Primary Examiner*—David J. Walczak
(74) *Attorney, Agent, or Firm*—Jack Lo

(57) ABSTRACT

A writing instrument is comprised of an elongated body with a writing point at the lower end, and an upper end for supporting the base of the index finger. Arcuate arms extending up from the upper end of the body are arranged for being positioned on the sides of the index finger. A concave front groove is arranged along the front side of the body for cradling the tip of the index finger. Concave side grooves are arranged along the sides of the body for cradling the tips of the thumb and middle finger. Forwardly protruding ears are arranged between the front and respective sides for being pinched between the index finger and the thumb, and between the index finger and the middle finger. A knob on the rear of the body is movable for retracting or extending a cap to expose or cover the writing point.

11 Claims, 4 Drawing Sheets

ERGONOMIC WRITING INSTRUMENT

BACKGROUND OF THE INVENTION

1. Field of the Invention

This invention relates generally to writing instruments.

2. Prior Art

Conventional straight writing instruments such as ink pens, ball point pens, and pencils have straight and narrow cylindrical bodies. The lower portion of a typical writing instrument is arranged to be held between the tips of the thumb, index finger, and middle finger. The upper portion of the pen is arranged to rest between the bases of the thumb and index finger. The narrow round bodies of conventional writing instruments require a relatively firm grip to prevent them from slipping, and to push the pen onto the writing surface. Therefore, they are uncomfortable to use for long periods.

Many other alternative writing instruments that attempt to provide a better grip are known among the prior art. U.S. Pat. No. 336,540 to Wyttenbach and U.S. Pat. No. 340,382 to Smith each disclose a pen with a short tip and a pair of bifurcated arms extending from the tip. The arms rest on opposite sides of the index finger. The tip is round and suffers the same gripping problems as a conventional pen. U.S. Pat. No. 4,127,338 to Laybourne discloses a fingertip pen with a ring at an upper end for being positioned forward of the middle joint of the index finger. A curved depression on a top side is arranged for supporting the tip of the index finger. However, the tip is round and suffers the same gripping problems as a conventional pen.

U.S. Pat. No. 5,391,010 to Gorbunov discloses a pen with a ring arranged for being positioned around the base of the index finger. It includes a depression at the tip for supporting the tip of the index finger, but the depression is curved about an axis which is transverse to the axis of the pen. The index finger can thus slip sideways in the depression. The sides of the pen are cylindrical, and suffers the same gripping problems as a conventional pen. U.S. Pat. No. 5,885,018 to Sato discloses a pen with a round shaft attached on the lower surface of a curved plate. A partial ring is formed at the top end of the plate for gripping the finger forward of the middle joint. The shaft is about the diameter of an ink tube inside a conventional ballpoint pen. The plate is much wider than the shaft, which is so narrow that it cannot be gripped securely. The fingers can only grip the top and bottom surfaces of the thin plate.

U.S. Pat. No. 6,161,974 to Nakagawa discloses a pen with a ring. The axis of the ring is transverse to the axis of the pen for passing the index finger, which is held in a fully curled position. Only the thumb and the index finger are available for gripping the tip of the pen. Further, the tip is cylindrical, and suffers the same gripping problems as a conventional pen. U.S. Pat. No. Des. 246,904 to MacIntosh discloses a fingertip pen with a cylindrical tip, a concave upper body, and a ring attached to the upper body. The tip is round and suffers the same gripping problems as a conventional pen.

BRIEF SUMMARY OF THE INVENTION

The objects of the present ergonomic pen are:

- to require less gripping force to hold for improved comfort;
- to securely cradle the tips of the thumb and fingers for preventing slipping;
- to be pressed onto the writing surface by the base of the index finger; and

- to cover the writing tip when not in use.

The present writing instrument is comprised of an elongated body with a writing point at the lower end, and an upper end for supporting the base of the index finger. Arcuate arms extending up from the upper end of the body are arranged for being positioned on the sides of the index finger. A concave front groove with an arcuate cross section is arranged along the front side of the body, and curved about an axis parallel to the axis of the body for cradling the tip of the index finger and preventing it from slipping sideways. The upper end of the front groove is flared into the upper end of the body for cradling the lower side of the base of the index finger. The lower end of the front groove is rounded for preventing the index finger from slipping downward. Concave side grooves with arcuate cross sections are arranged along the sides of the body, and curved about axes parallel to the axis of the body for cradling the tips of the thumb and middle finger to prevent them from slipping forward. The body has a generally trapezoidal cross section wherein the front is wider than the rear, and the sides taper toward the rear. Forwardly protruding ears are arranged between the front and sides for being pinched between the index finger and the thumb, and between the index finger and the middle finger. A cap is movably attached to the lower end of the body. A knob on the rear side of the body is movable upward to retract the cap and expose the writing tip, and movable downward to extend the cap to cover the writing tip.

DRAWING REFERENCE NUMERALS

10. Pad
11. Writing Point
12. Arcuate Arm
13. Arcuate Arm
14. Front Groove
15. Flared Portion
16. Rounded Portion
17. Side Groove
18. Side Groove
19. Ear
20. Ear
21. Cap
22. Knob

DETAILED DESCRIPTION OF THE INVENTION

Figure 1:
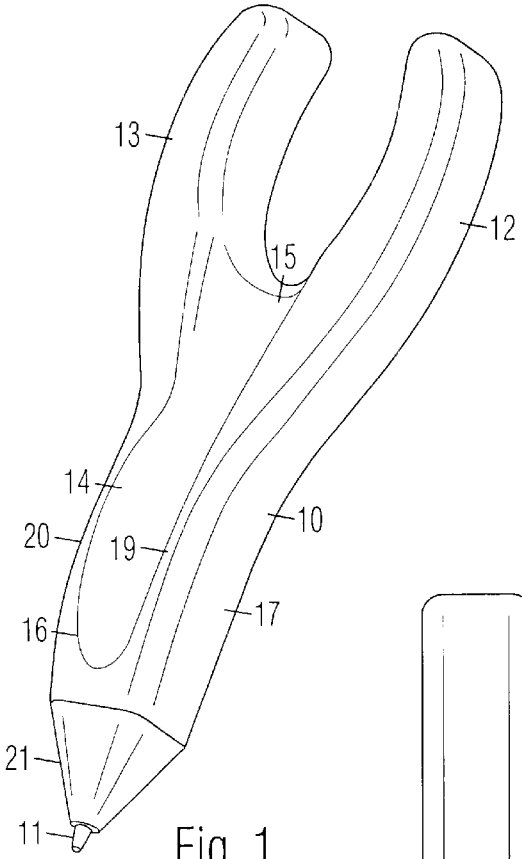
FIG. 1 is a front perspective view of the present writing instrument.
Figure 2:
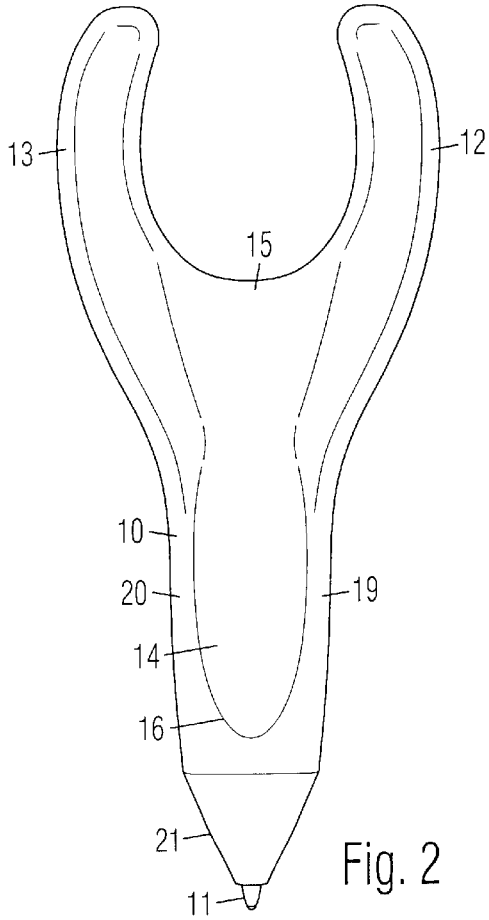
FIG. 2 is a front view thereof.
Figure 3:
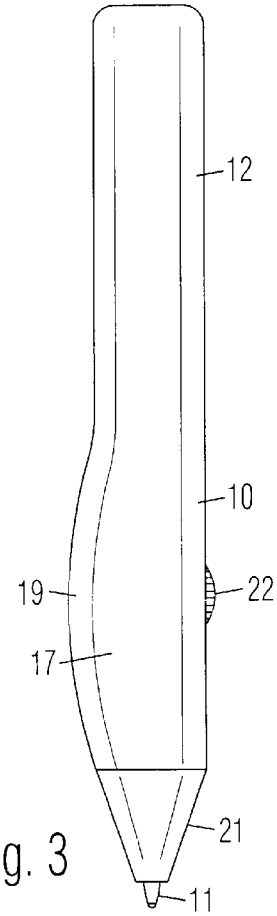
FIG. 3 is a left side view thereof.

FIGS. 1–4:

A preferred embodiment of the present writing instrument is shown in a front perspective view in FIG. 1, a front view in FIG. 2, a side view in FIG. 3, and a lower end view in FIG.

4. It may be an ink pen, a ball point pen, a felt tip pen, a pencil, a stylus, a digital pen, or any other tool for writing. It is comprised of an elongated body 10 with a writing point 11 projecting from the lower end, and an upper end for supporting the base of the index finger. Body 10 is preferably about as long as the index finger so that its upper end is positioned for supporting the base of the index finger.

A pair of arms 12 and 13 extending up from the upper end of body 10 are arranged for being positioned on either side of the index finger. The upper ends of arms 12 and 13 are disconnected from each other for allowing the index finger to easily move in between them. Arms 12 and 13 are generally coplanar with body 10. Arms 12 and 13 are preferably arcuate arms that are curved about respective axes perpendicular to the axis of body 10.

A concave front groove 14 with an arcuate cross section is arranged along the front side of body 10, and curved about an axis parallel to the axis of body 10 for cradling the tip of the index finger and preventing it from slipping sideways. The upper end of front groove 14 has a flared portion 15 into the upper end of the body 10 for supporting the lower side of the base of the index finger. The lower end of front groove 14 has a rounded portion 16 for preventing the tip of the index finger from slipping downward. Concave side grooves 17 and 18 with arcuate cross sections are arranged along the sides of body 10, and curved about respective axes parallel to the axis of body 10 for cradling the tips of the thumb and middle finger to prevent them from slipping forward toward the index finger.

Figure 4:
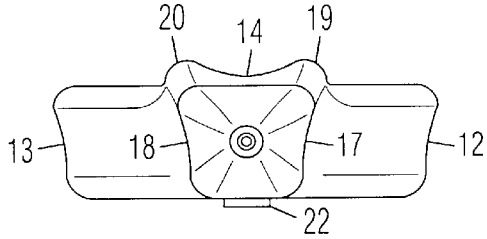
FIG. 4 is a lower end view thereof.

As shown in FIG. 4, body 10 has a generally trapezoidal cross section wherein the front is wider than the rear, and the sides taper toward the rear. Outwardly protruding ears 19 and 20 are respectively arranged between concave front groove 14 and concave side groove 17, and between concave front groove 14 and concave side groove 18. Ears 19 and 20 are respectively arranged for being pinched between the index finger and the thumb, and between the index finger and the middle finger.

A cap 21 is movably attached to the lower end of body 10 and connected to a cap control knob 22 on the rear of body 10.

Figure 5:
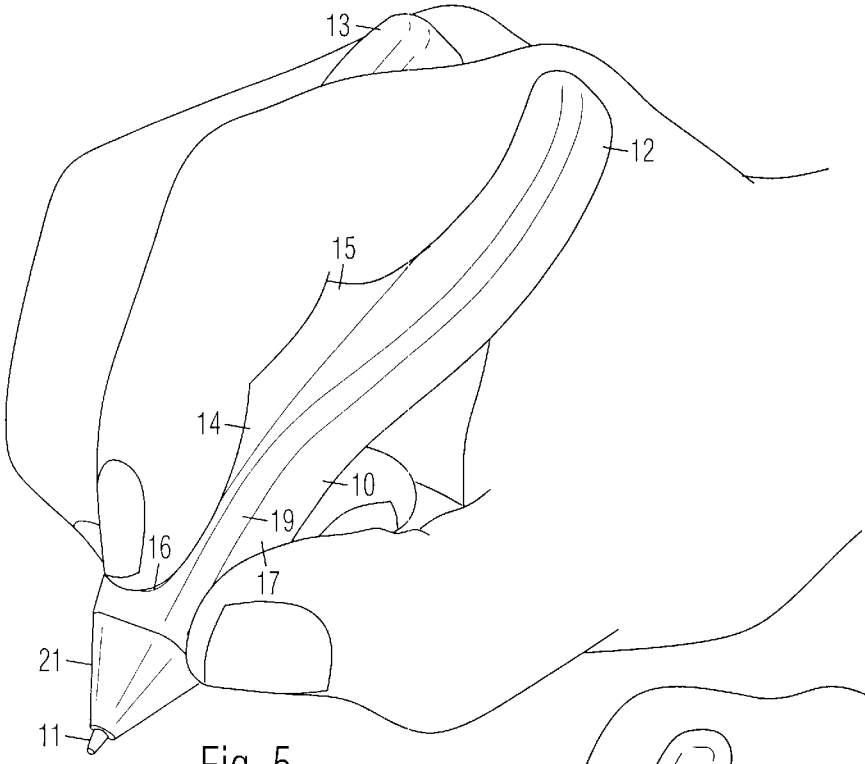
FIG. 5 is a front perspective view thereof in use.
Figure 6:
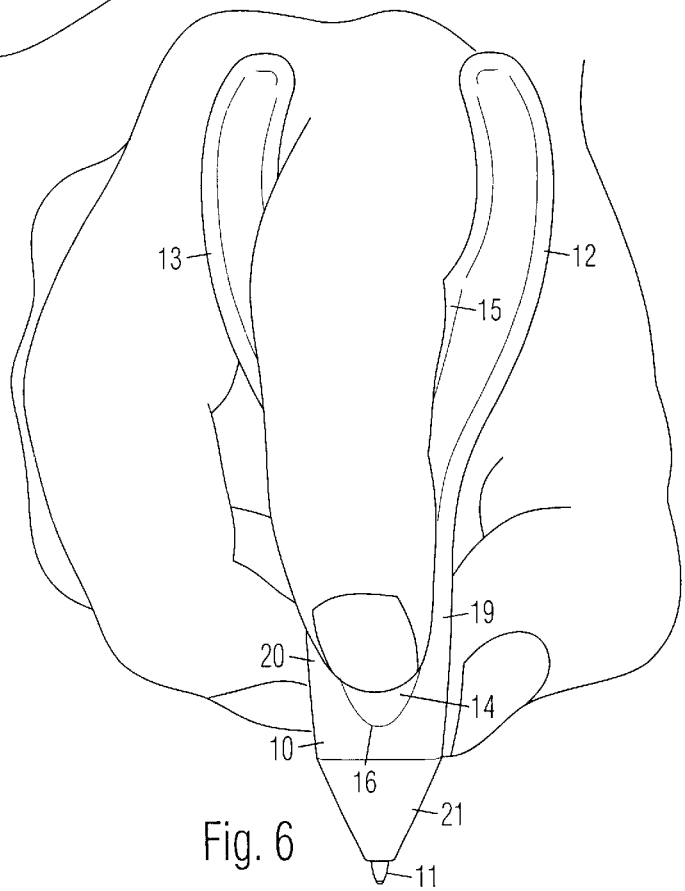
FIG. 6 is a front view thereof in use.
Figure 7:
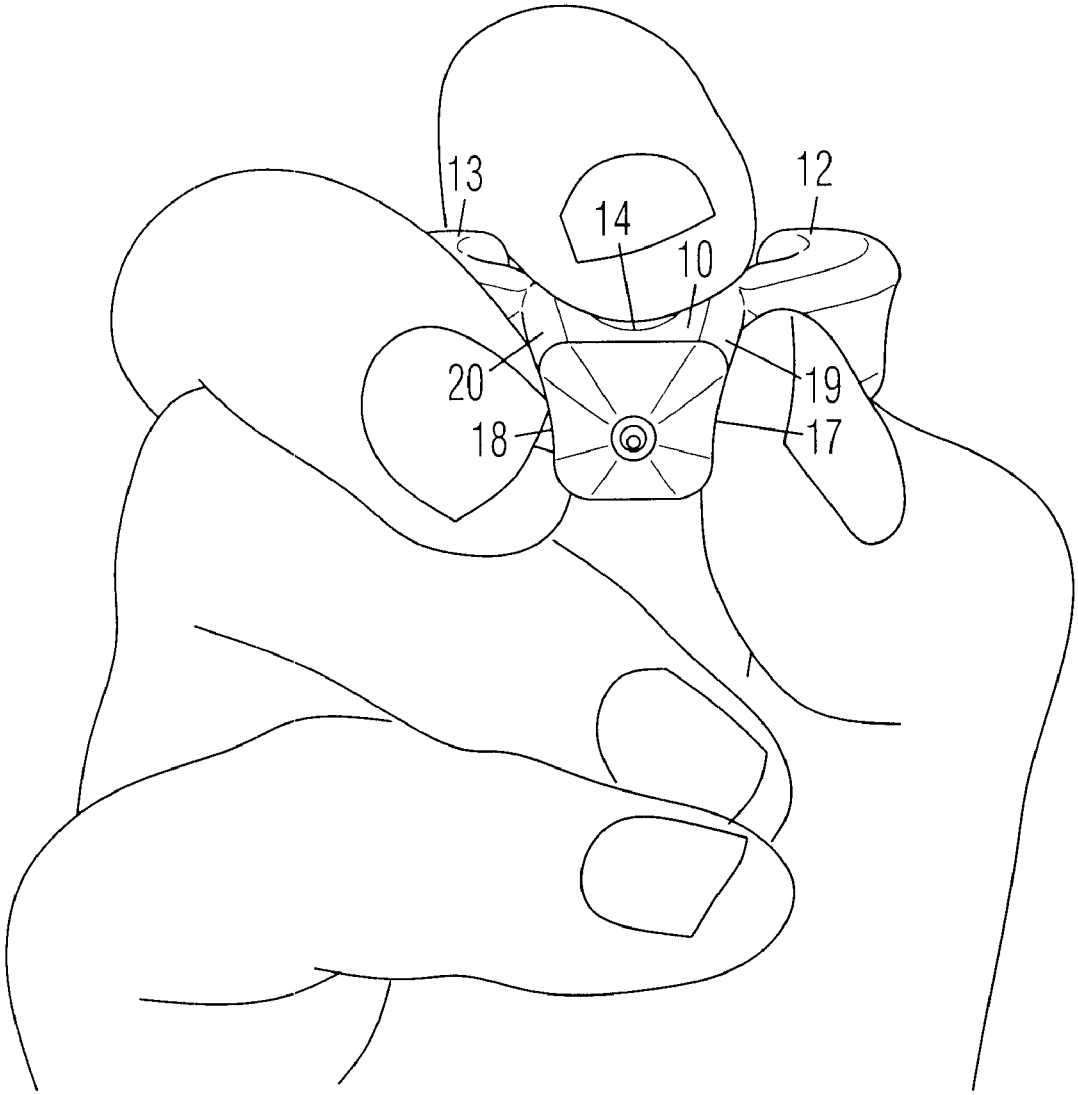
FIG. 7 is a lower end perspective view thereof in use.

FIGS. 5–7:

The writing instrument is shown in use in FIGS. 5–7. The lower end of body 10 is gripped between the tips of the thumb, index finger, and middle finger. The base of the index finger is positioned between arms 12 and 13, and the lower side of the base of the index finger is supported on the upper end of body 10.

As shown in FIG. 7, the index finger is pressed against front groove 14, which prevents the index finger from slipping sideways. The thumb is pressed against left side groove 17, which prevents the thumb from slipping forwardly toward the index finger. The middle finger is pressed against right side groove 18, which prevents the middle finger from slipping forwardly toward the index finger. Left ear 19 is pinched between the thumb and the index finger, and right ear 20 is pinched between the middle finger and the index finger. The writing instrument is thus shaped for a better grip, so that it may be gripped with less force for improved comfort.

As shown in FIGS. 5 and 6, body 10 is sized to support the lower side of the base of the index finger with its upper end. Therefore, the weight of the hand is partially supported by body 10, and the writing tip is pressed by the weight of the hand onto the writing surface. The need for the fingertips to press the writing instrument onto the writing surface is greatly reduced, which further reduces the need for a firm grip and further improves comfort.

Figure 8:
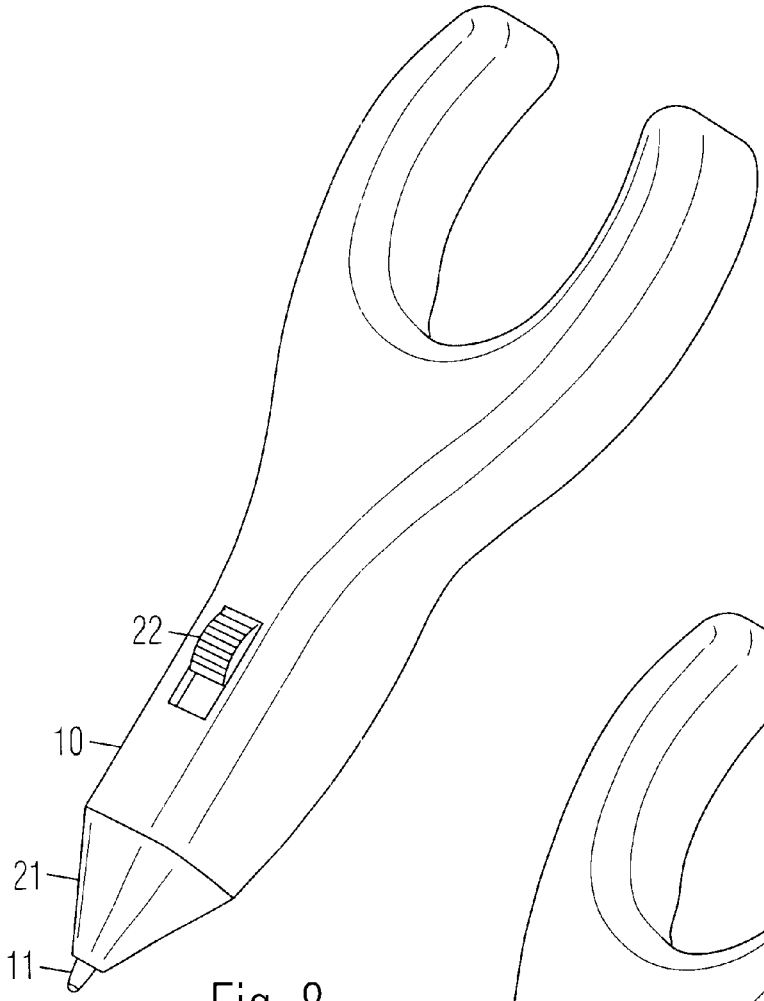
FIG. 8 is a rear perspective view thereof when a cap is retracted.
Figure 9:
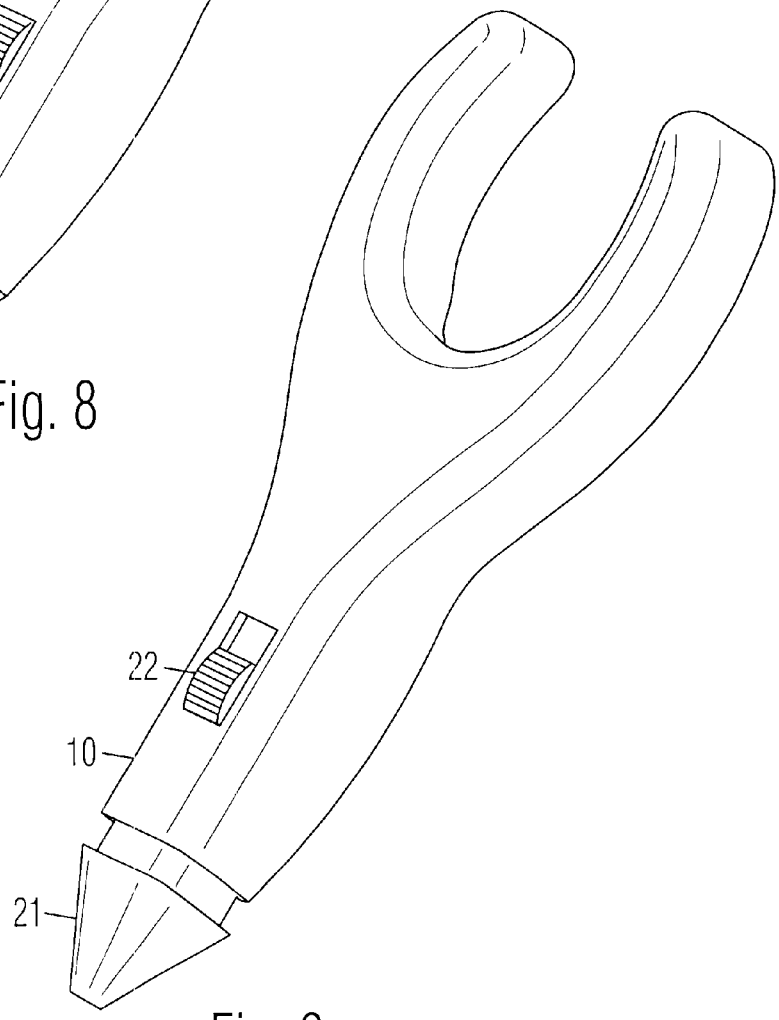
FIG. 9 is a rear perspective view thereof when the cap is extended.

FIGS. 8-9:

As shown in FIGS. 8–9, knob 22 is movable upward to retract cap 21 and expose writing point 11, and movable downward to extend cap 21 to cover writing point 11.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A writing instrument, comprising:

an elongated body for being held in a hand, wherein said body includes a longitudinal axis, a front for facing away from said hand, a rear for facing said hand, a lower end for positioning adjacent a writing surface, and an upper end for supporting a base of an index finger, said body having a generally trapezoidal cross section wherein said front is wider than said rear, and said opposite sides taper toward said rear;

a writing point at said lower end of said body for being pressed onto said writing surface by said base of said index finger; and a pair of arms extending up from said upper end of said body for being positioned on opposite sides of said index finger.

2. The writing instrument of claim 1, wherein said body is about as long as said index finger, so that said upper end of said body is positioned for supporting said base of said index finger.

3. The writing instrument of claim 1, wherein said arms are curved about axes generally perpendicular to said axis of said body.

4. The writing instrument of claim 1, further including a movable cap attached to said lower end of said body, and a movable knob on said body connected to said cap, wherein said knob is movable upward to retract said cap and expose said writing tip, and movable downward to extend said cap to cover said writing tip.

5. A writing instrument, comprising:

an elongated body for being held in a hand, wherein said body includes a longitudinal axis, a front for facing away from said hand, a rear for facing said hand, a lower end for positioning adjacent a writing surface, and an upper end for supporting a base of an index finger;

a writing point at said lower end of said body for being pressed onto said writing surface by said base of said index finger;

a pair of arcuate arms extending up from said upper end of said body for being positioned on opposite sides of said index finger, wherein upper ends of said arms are disconnected from each other for facilitating said index finger to move in between said arms, said arms are generally coplanar with said body;

a concave front groove with an arcuate cross section arranged along said front of said body, and curved about an axis parallel to said axis of said body for cradling a tip of said index finger and preventing sideways slippage, wherein an upper end of said front groove includes a flared portion for cradling a lower side of said base of said index finger, and a lower end of said front groove includes a rounded portion for preventing said index finger from slipping downward toward said lower end of said body;

a concave left side groove and a concave right side groove with arcuate cross sections arranged along opposite sides of said body, and curved about axes parallel to said axis of said body for cradling respective tips of a thumb and a middle finger to prevent forward slippage toward said index finger; and a protruding left ear and a protruding right ear respectively arranged between said front and said opposite sides of said body for being pinched between said thumb and said index finger, and between said middle finger and said index finger.

6. The writing instrument of claim 5, wherein said body is about as long as said index finger, so that said upper end of said body is positioned for supporting said base of said index finger.

7. The writing instrument of claim 5, wherein said arms are curved about axes generally perpendicular to said axis of said body.

8. The writing instrument of claim 5, wherein said body has a generally trapezoidal cross section wherein said front is wider than said rear, and said opposite sides taper toward said rear.

9. The writing instrument of claim 5, further including a movable cap attached to said lower end of said body, and a movable knob on said body connected to said cap, wherein said knob is movable upward to retract said cap and expose said writing tip, and movable downward to extend said cap to cover said writing tip.

10. A writing instrument, comprising:

an elongated body for being held in a hand, wherein said body includes a longitudinal axis, a front for facing away from said hand, a rear for facing said hand, a lower end for positioning adjacent a writing surface, and an upper end for supporting a base of an index finger;

a writing point at said lower end of said body for being pressed onto said writing surface by said base of said index finger;

a pair of arcuate arms extending up from said upper end of said body for being positioned on opposite sides of said index finger, wherein upper ends of said arms are disconnected from each other for facilitating said index finger to move in between said arms, said arms are generally coplanar with said body, and are curved about axes generally perpendicular to said axis of said body;

a concave front groove with an arcuate cross section arranged along said front of said body, and curved about an axis parallel to said axis of said body for cradling a tip of said index finger and preventing sideways slippage, wherein an upper end of said front groove includes a flared portion for cradling a lower side of said base of said index finger, and a lower end of said front groove includes a rounded portion for preventing said index finger from slipping downward toward said lower end of said body;

a concave left side groove and a concave right side groove with arcuate cross sections arranged along opposite sides of said body, and curved about axes parallel to said axis of said body for cradling respective tips of a thumb and a middle finger to prevent forward slippage toward said index finger;

wherein said body has a generally trapezoidal cross section wherein said front is wider than said rear, and said opposite sides taper toward said rear;

a protruding left ear and a protruding right ear respectively arranged between said front and said opposite sides of said body for being pinched between said thumb and said index finger, and between said middle finger and said index finger;

a movable cap attached to said lower end of said body; and a movable knob on said body connected to said cap, wherein said knob is movable upward to retract said cap and expose said writing tip, and movable downward to extend said cap to cover said writing tip.

11. The writing instrument of claim 10, wherein said body is about as long as said index finger, so that said upper end of said body is positioned for supporting said base of said index finger.

* * * * *